US005947079A

United States Patent [19]

Sivashankar et al.

[11] Patent Number: 5,947,079

[45] Date of Patent: Sep. 7, 1999

[54] MODE CONTROL SYSTEM FOR DIRECT INJECTION SPARK IGNITION ENGINES

[75] Inventors: Narayanan Sivashankar, Canton; Jing Sun, Novi, both of Mich.

[73] Assignee: Ford Global Technologies, Inc., Dearborn, Mich.

[21] Appl. No.: 09/093,022

[22] Filed: Jun. 8, 1998

[51] Int. Cl.[6] ..... F02B 17/00; F02P 5/00

[52] U.S. Cl. ..... 123/295; 123/435; 123/406.45

[58] Field of Search ..... 123/295, 305, 123/406.45, 406.48, 480, 435, 406.2, 406.21

[56] References Cited

U.S. PATENT DOCUMENTS

| | | | |
|---|---|---|---|
| 5,203,300 | 4/1993 | Orzel | 123/339.12 |
| 5,331,933 | 7/1994 | Matsushita | 123/295 |
| 5,682,856 | 11/1997 | Tomisawa et al. | 123/435 |
| 5,740,780 | 4/1998 | Shimizu et al. | 123/435 |
| 5,881,693 | 3/1999 | Mizuno | 123/435 |
| 5,896,840 | 4/1999 | Takahashi | 123/295 |
| 5,904,129 | 5/1999 | Kadota | 123/406.48 |

*Primary Examiner*—Willis R. Wolfe
*Assistant Examiner*—Hieu T. Vo
*Attorney, Agent, or Firm*—Allan J. Lippa

[57] ABSTRACT

A mode control system for a direct injection spark ignition engine is controlled to operate in either homogeneous air/fuel modes or stratified air/fuel modes. When transitioning from homogeneous to stratified mode, the throttle is used to adjust manifold pressure to a level where it is possible to operate in a stratified mode with a torque equal to that of the homogeneous model. When transitioning from a stratified to a homogeneous model, the throttle is used to adjust manifold pressure to a level where it is possible to operate in a homogeneous model with a torque equal to that of the stratified mode. During the transition, other engine operating conditions are used to assist in controlling engine torque.

15 Claims, 5 Drawing Sheets

MODE CONTROL SYSTEM FOR DIRECT INJECTION SPARK IGNITION ENGINES

BACKGROUND OF THE INVENTION

The field of the invention relates to control of direct injection engines. In particular, the field relates to control of air/fuel mode transitions for direct injection spark ignition engines.

In conventional port injected engines, which induct a mixture of air and atomized fuel into the combustion chambers, control systems are known which adjust engine torque by controlling the air throttle. It is also known to control engine torque by advancing or retarding ignition timing. An example of such a system is disclosed in U.S. Pat. No. 5,203,300.

The inventors herein have recognized numerous problems when applying known engine torque control systems to direct injection spark ignition engines in which the combustion chambers contain stratified layers of different air/fuel mixtures. The strata closest to the spark plug contains a stoichiometric mixture or a mixture slightly rich of stoichiometry, and subsequent strata contain progressively leaner mixtures. Use of conventional torque control systems for this type of engine is recognized by the inventors herein to be inadequate because stratified operation is unthrottled so the throttle is not a viable control variable. And ignition timing is not a viable control variable because the timing must be slaved to the time a rich air/fuel strata is formed near the spark plug. These problems are further exasperated in direct injection spark ignition engines which have two modes of operation—the stratified mode discussed above and a homogeneous mode in which a homogeneous air/fuel mixture is formed at the time of spark ignition.

A particular problem in controlling engine torque in a DISI engine is transitioning between one mode of operation to the other while maintaining a controlled engine torque. This is necessary to prevent sudden dips or bumps in engine speed caused by a sudden drop or rise in engine torque. For example, this is important during the idling operation where a mode transition from stratified to homogeneous is necessary to purge fuel vapors in the vapor recovery system.

SUMMARY OF THE INVENTION

An object of the invention herein is to control torque of direct injection spark ignition internal combustion engines while transitioning between homogeneous and stratified air/fuel modes of operation.

The above object is achieved, problems of prior approaches overcome, and the inherent advantages obtained, by providing a mode control method for a spark ignited engine having an air intake with a throttle positioned therein and having a homogeneous mode of operation with a homogeneous mixture of air and fuel within a plurality of combustion chambers and a stratified mode of operation with a stratified mixture of air and fuel within the plurality of combustion chambers. The method comprises estimating an initial stratified manifold pressure and an initial stratified torque, estimating a first expected homogeneous torque based on said initial stratified manifold pressure, when said first expected homogeneous torque is less than said initial stratified torque, adjusting an injection timing for the homogeneous mode of operation while adjusting an ignition timing to move said first expected homogeneous torque towards said initial stratified torque, and when said first expected homogeneous torque is greater than said initial stratified torque, adjusting the throttle to reduce said first expected homogeneous torque by a predetermined amount and subsequently adjusting an injection timing for the homogeneous mode of operation while adjusting an ignition timing to move said first expected homogeneous torque towards said initial stratified torque.

An advantage of the above aspect of the invention is that engine torque is accurately maintained regardless of whether a direct injection spark ignition engine is transitioning from a homogeneous mode to a stratified mode or a stratified mode to a homogeneous mode.

DESCRIPTION OF THE DRAWINGS

The object and advantages of the invention claimed herein will be more readily understood by reading an example of an embodiment in which the invention is used to advantage with reference to the following drawings wherein:

DESCRIPTION OF AN EXAMPLE OF OPERATION

Figure 1:
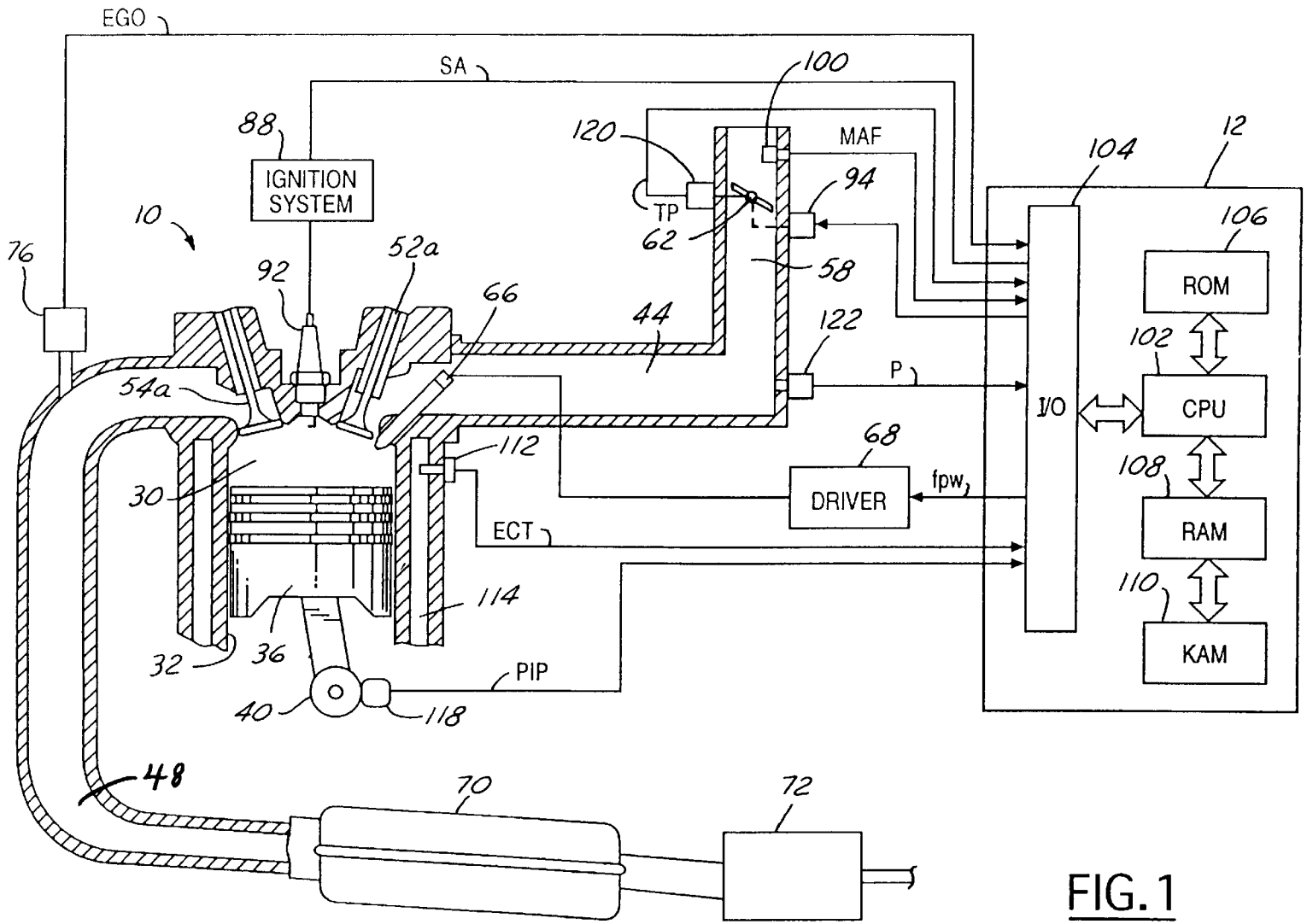
FIG. 1 is a block diagram of an embodiment in which the invention is used to advantage.

Direct injection spark ignited internal combustion engine 10, comprising a plurality of combustion chambers, is controlled by electronic engine controller 12. Combustion chamber 30 of engine 10 is shown in FIG. 1 including combustion chamber walls 32 with piston 36 positioned therein and connected to crankshaft 40. In this particular example piston 36 includes a recess or bowl (not shown) to help in forming stratified charges of air and fuel. Combustion chamber 30 is shown communicating with intake manifold 44 and exhaust manifold 48 via respective intake valves 52*a* and 52*b* (not shown), and exhaust valves 54*a* and 54*b* (not shown). Fuel injector 66 is shown directly coupled to combustion chamber 30 for delivering liquid fuel directly therein in proportion to the pulse width of signal fpw received from controller 12 via conventional electronic driver 68. Fuel is delivered to fuel injector 66 by a conventional high pressure fuel system (not shown) including a fuel tank, fuel pumps, and a fuel rail.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC) which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Conventional distributorless ignition system 88 provides ignition spark to combustion chamber 30 via spark plug 92 in response to spark advance signal SA from controller 12.

Controller 12 causes combustion chamber 30 to operate in either a homogeneous air/fuel mode or a stratified air/fuel mode by controlling injection timing. In the stratified mode, controller 12 activates fuel injector 66 during the engine compression stroke so that fuel is sprayed directly into the bowl of piston 36. Stratified air/fuel layers are thereby formed. The strata closest to the spark plug contains a stoichiometric mixture or a mixture slightly rich of stoichiometry, and subsequent strata contain progressively leaner mixtures. During the homogeneous mode, controller 12 activates fuel injector 66 during the intake stroke so that a substantially homogeneous air/fuel mixture is formed when ignition power is supplied to spark plug 92 by ignition system 88. Controller 12 controls the amount of fuel delivered by fuel injector 66 so that the homogeneous air/fuel mixture in chamber 30 can be selected to be at stoichiometry, a value rich of stoichiometry, or a value lean of stoichiometry. The stratified air/fuel mixture will always be at a value lean of stoichiometry, the exact air/fuel being a function of the amount of fuel delivered to combustion chamber 30.

Nitrogen oxide (NOx) absorbent or trap 72 is shown positioned downstream of catalytic converter 70. NOx trap 72 absorbs NOx when engine 10 is operating lean of stoichiometry. The absorbed NOx is subsequently reacted with HC and catalyzed during a NOx purge cycle when controller 12 causes engine 10 to operate in either a rich homogeneous mode or a stoichiometric homogeneous mode.

Controller 12 is shown in FIG. 1 as a conventional microcomputer including: microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including: measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120; and absolute Manifold Pressure Signal P from sensor 122. Engine speed signal RPM is generated by controller 12 from signal PIP in a conventional manner and manifold pressure signal P provides an indication of engine load.

Figure 2:
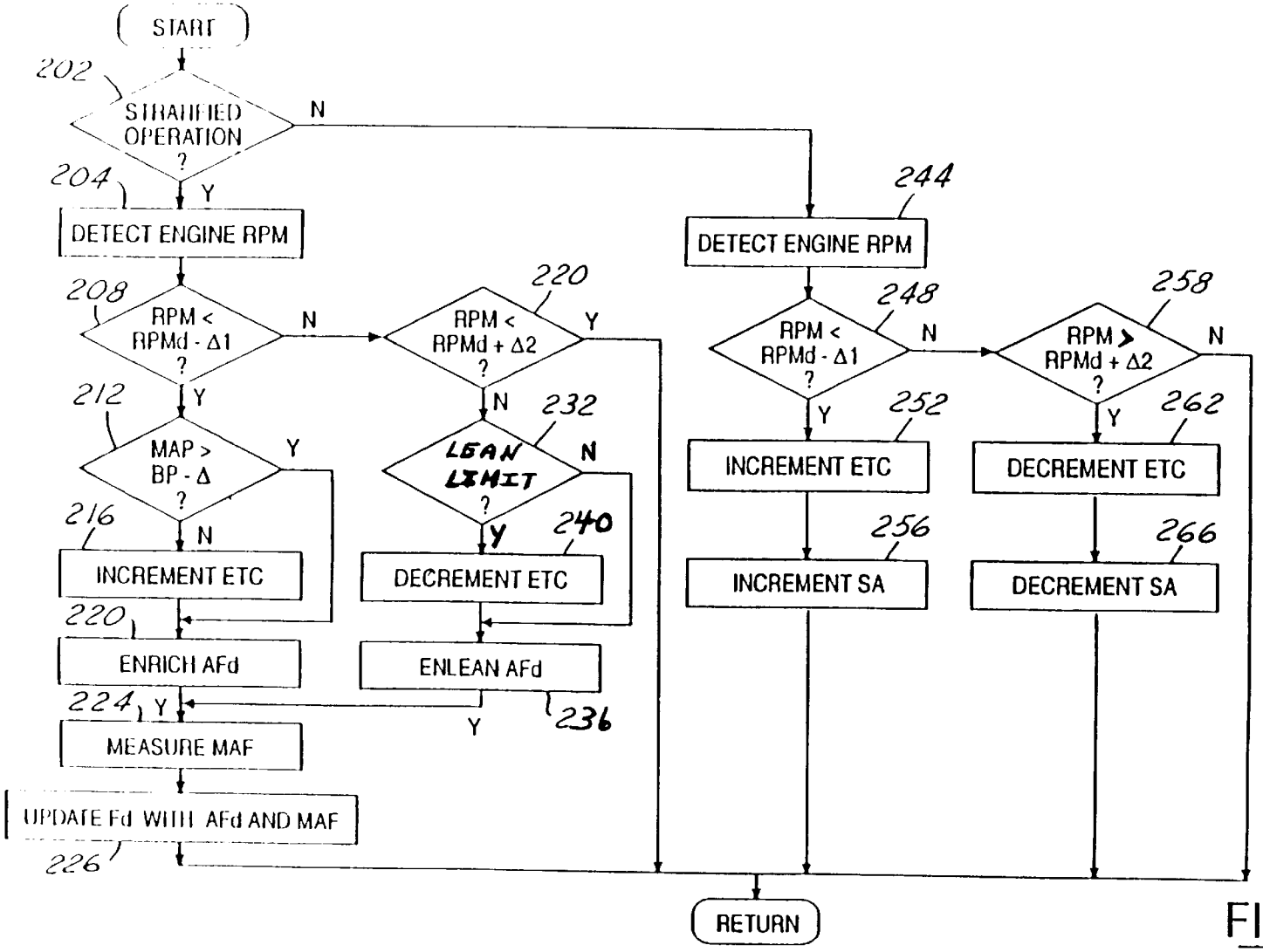
FIG. 2 is a high level flowchart which describes an example of torque control applied to idle speed operation for the embodiment shown in FIG. 1.

Referring now to FIG. 2, an example of torque control applied to idle speed control operation is now described for the stratified and homogeneous modes of operation. When engine 10 is operated in the stratified mode (block 202), engine RPM is detected (block 204) and the following comparison is made. When engine RPM is less than desired engine speed RPMd −Δ1, which provides a deadband around desired speed RPMd (block 208), conditions are checked to see if engine 10 is throttled. In this particular example an indication of throttled conditions is provided, when manifold pressure signal MAP is less than barometric pressure BP minus Δ (block 212). In response, throttle plate 62 is incremented (block 216) by operation of the electronic throttle control (ETC). On the other hand, when engine manifold pressure signal MAP is greater than barometric pressure BP minus Δ (block 212), the position of throttle plate 62 is not changed and block 216 bypassed as shown in FIG. 2. Regardless of whether engine 10 is throttled or unthrottled, desired air/fuel signal AFd is enriched (block 220) whenever engine speed RPM is less than desired speed RPMd minus Δ1 (block 208).

When engine speed RPM is greater than desired engine speed RPMd −Δ1 (block 208), but less than desired engine speed RPMd +Δ2 (block 228), engine speed RPM is then known to be operating within a dead band around desired engine speed RPMd and no action is taken to change engine idle speed RPM. On the other hand, when engine speed is greater than desired speed RPMd +Δ2 (block 228), subsequent steps are taken to control engine idle speed as follows. Desired air/fuel AFd is enleaned (block 236) unless a lean limit is reached (block 232). If the lean limit is reached (block 232), the position of throttle plate 62 is decremented (block 240).

When in stratified operation (block 202), the routine described above continues by measuring inducted airflow MAF (block 224) and updating the fuel delivered to the combustion chambers (Fd) utilizing a measurement of inducted airflow (MAF) and desired air/fuel AFd.

A description of idle speed control during the homogeneous modes of operation is now described with particular reference to blocks 244–266. Engine speed RPM is detected (block 244) after homogeneous operation is indicated (block 202). When engine speed RPM is less than desired speed RPMd −Δ1 (block 248), throttle plate 62 is incremented (block 252) to increase idle speed. In addition, ignition timing SA is advanced (block 256) to more rapidly correct engine idle speed.

When engine speed RPM is greater than desired speed RPMd +Δ2 (blocks 248 and 258), throttle plate 62 is decremented or moved towards the closed position by action of electronic throttle control (ETC) as shown in block 262 to decrease engine speed. To further decrease engine speed, and do so rapidly, ignition timing is retarded in block 266.

When engine speed RPM is within a dead band around desired speed RPMd (blocks 248 and 258), no steps are taken to alter engine speed.

Figure 3:
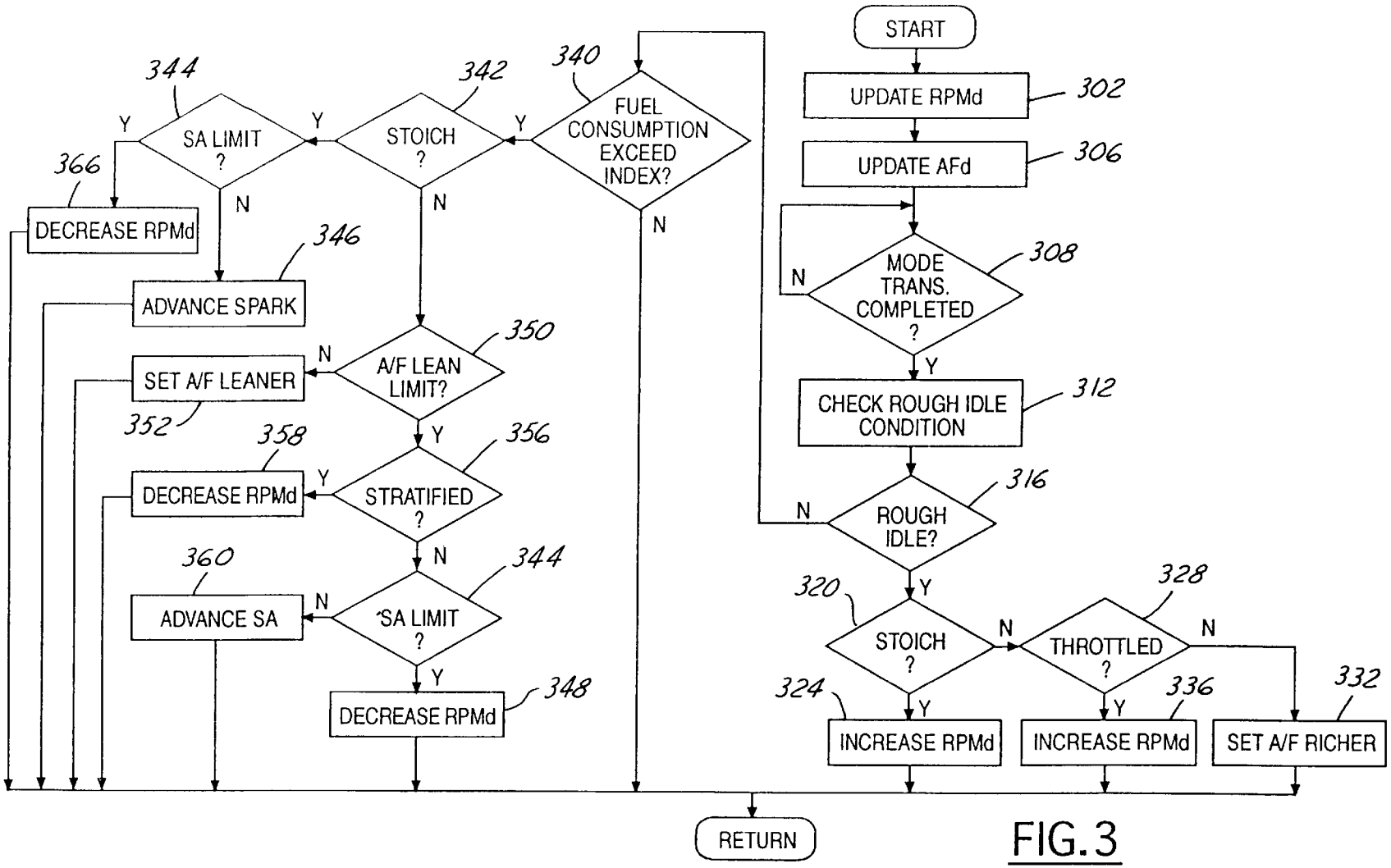
FIG. 3 is a high level flowchart showing how a desired idle speed is generated for the example in FIG. 2.

Referring now to FIG. 3, a high level flowchart is shown for generating a desired idle speed to maximize fuel economy for use in the routine described in reference to FIG. 2. After the idle speed mode is started, desired idle engine speed RPMd (block 302) and desired air/fuel AFd (block 306) are updated. After a transition in modes from the previous operating mode is completed (block 308), which is described later herein with particular reference to FIGS. 4 and 5, a check for rough idle conditions is made (block 312). Rough idle is detected by detecting a change in crankshaft velocity. Those skilled in the art will recognize that there are many other methods for checking rough idle conditions. For example, variations in alternator current are commonly used as are abrupt changes in air/fuel of the combustion gas air/fuel.

When rough idle conditions are present (block 316), and engine 10 is operating at stoichiometry (block 320), desired idle speed RPMd is increased to smooth out the engine idle (block 324).

The following operations occur when engine idle is rough (block 316) and engine operation is at non stoichiometric air/fuel (block 320). If engine operation is also throttled (block 328), desired idle speed RPMd is increased (block 336). If, however, engine operation is unthrottled (block 328) and stratified, engine air/fuel is enriched until a rich limit is reached which will cause operation to switch to homogeneous (block 332).

In the absence of rough idle conditions (block 316), the following steps are implemented to maximize fuel economy during the idle speed mode. When rough idle is not present (block 316), and fuel consumption is greater than desired (block 340), and engine 10 is operating at stoichiometric air/fuel (block 342), ignition timing is advanced (block 346) until an ignition advance limit is achieved (block 344). If the ignition advance limit is reached (block 344), desired idle speed RPMd is decreased (block 348).

If rough idle engine conditions are absent (block 316), and fuel consumption is greater than desired (block 340), and engine 10 is not at stoichiometry (block 342), engine air/fuel is set leaner (block 352) unless the lean air/fuel limit has been reached (block 350). If the lean air/fuel limit has been reached (block 350), and engine 10 is operating in a stratified mode (block 356), desired idle speed RPMd is decreased (block 358). On the other hand, if engine 10 is not operating in the stratified mode (block 356), ignition timing is advanced (block 360) until an ignition advance limit is reached (block 362). If the ignition timing advanced has been reached (block 362), desired idle speed RPMd is decreased (block 366).

Figure 4:
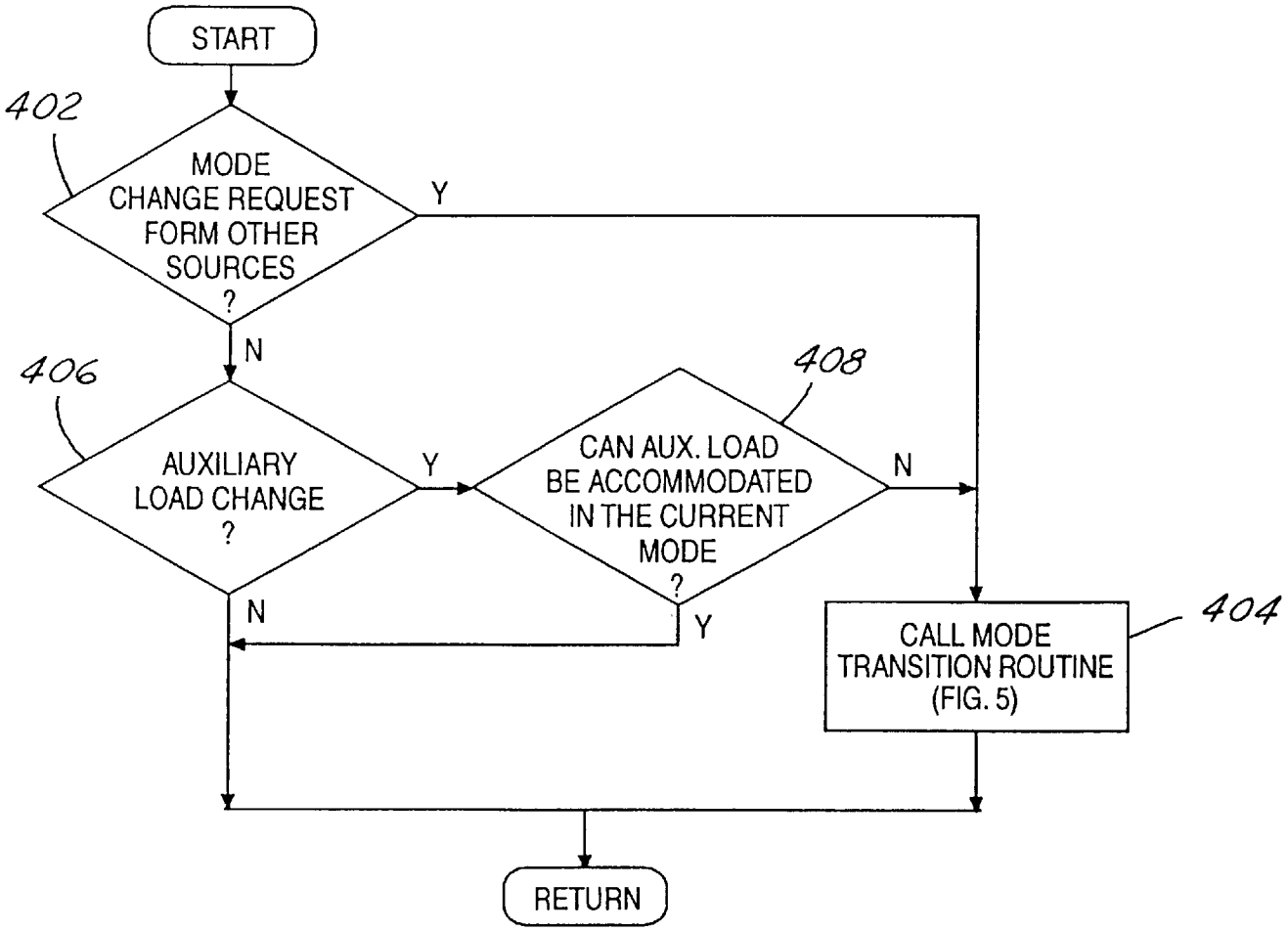
FIGS. 4 and 5 are high level flowcharts showing how mode transitions are accomplished.

Referring now to FIG. 4, according to the present invention, the mode transition decision routine is described for determining whether a transition from one mode to another or no transition is required. A determination is first made in step 402 whether a mode transition is requested from a high level controller, such as, for example, a vapor recovery control system, a lean NOx trap control system, a fuel economy control system, or any other system known to those skilled in the art and suggested by this disclosure that requires a specific mode of operation. When a mode transition is requested, the routine continues to step 404 to execute the mode transition routine described later herein with particular reference to FIG. 5. Otherwise, a determination is made in step 406 as to whether or not an auxiliary load change has been requested, such as, for example, activation or deactivation of the air conditioning compressor. When an auxiliary load change has been requested, the routine continues to step 408. In step 408, a determination is made as to whether the auxiliary load change can be accommodated in the current mode. If not, the routine continues to step 404 described previously herein to execute to mode transition routine.

Figure 5:
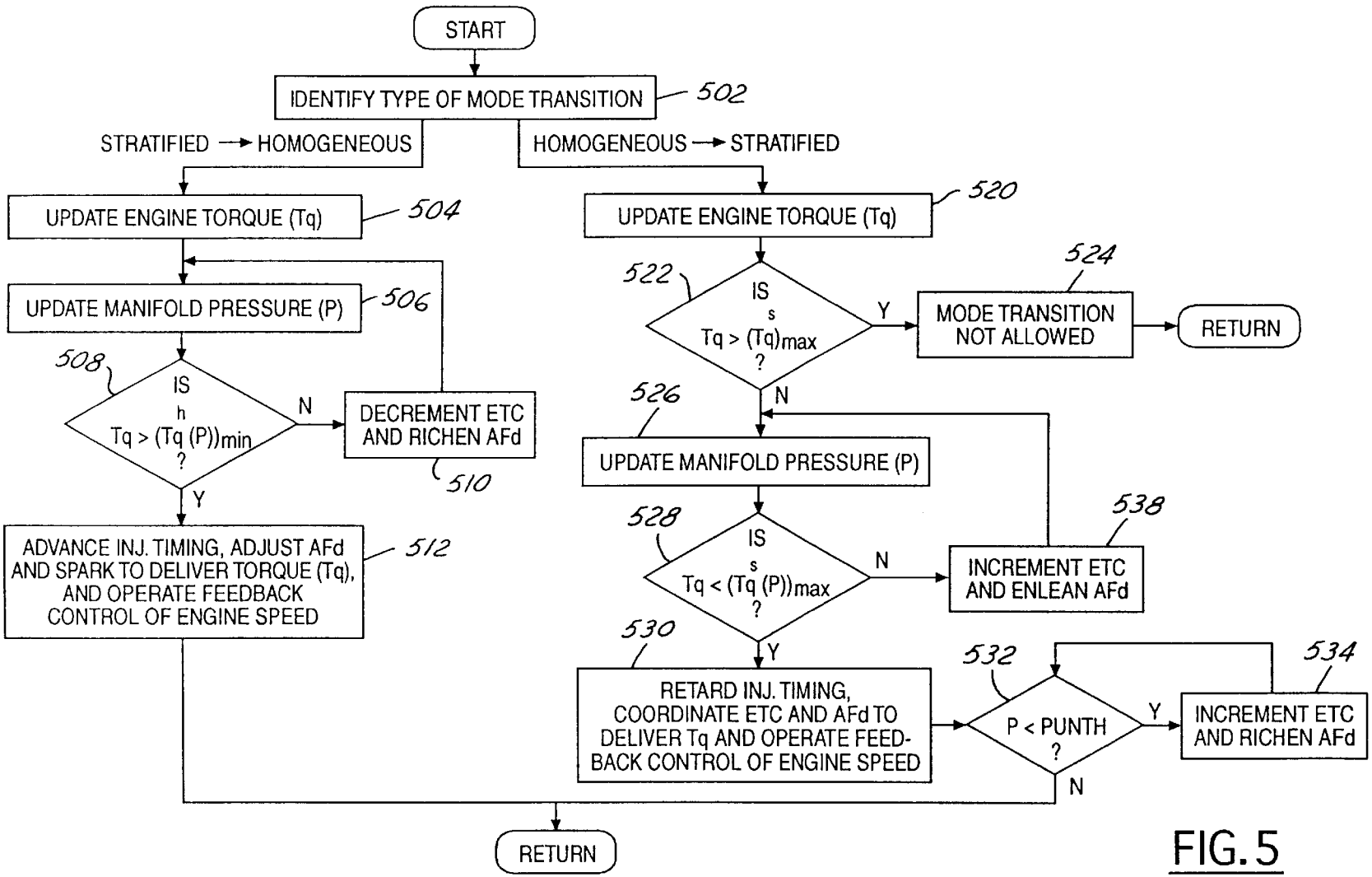

Referring now to FIG. 5, the mode transition routine is described for allowing the engine to transition from either stratified to homogeneous, or homogeneous to stratified operation. First, in step 502, the type of transition is identified. For example, if an auxiliary load change increases the necessary torque beyond that which can be accommodated in the stratified mode, then a transition to homogeneous may be desired. Alternatively, if purging of a NOx trap is completed, then a transition to stratified mode may be desired.

When a transition from stratified to homogeneous is requested, the engine torque (Tq) is updated in step 504. In a preferred embodiment, a function of the form shown below is used:

$$Tq=f_s(RPM, A/F_s, SA, EOI, P)$$

where, $A/F_s$ is the current stratified air/fuel ratio and EOI is the injection timing.

This function may be determined using mapping techniques to estimate an engine torque based on engine operating conditions, or may be substituted by using measurement techniques, such as, for example, by using cylinder pressure sensors. Then, in step 506, the manifold pressure (P) is updated. This can be done by, or example, measuring a manifold pressure sensor, or creating an estimate based on engine operating conditions. Next, in step 508, a determination is made as to whether the minimum expected homogeneous torque ($[Tq^h(P)]_{min}$) at the current manifold pressure is less than the engine torque (Tq). The minimum expected homogeneous torque ($[Tq^h(P)]_{min}$) at the current manifold pressure is determined as a function of engine operating conditions, limited by constraints, that provide the minimum possible torque at the current manifold pressure, and is shown below. For example, this is calculated with the air/fuel set at the lean homogeneous limit.

$$[Tq^h(P)]_{min}=\min[f_h(RPM, A/F_{hl}, SA_h, P)]$$

where, $A/F_{hl}$ is the homogeneous lean limit of engine air/fuel and $SA_h$ is the homogeneous injection timing limit.

If the answer is NO is step 508, then the routine continues to step 510, where throttle position and engine air/fuel are used to adjust the manifold pressure while maintaining constant torque. In particular, throttle position is decreased by action of electronic throttle controller ETC, thus throttling airflow, and engine air/fuel is richened. From step 510, the routine returns to step 506 described above herein. If the answer is YES in step 508, the routine continues to step 512 where injection timing is advanced and engine air/fuel and ignition timing are adjusted to maintain engine torque equal to Tq. Concurrently in step 512, feedback control may be used to maintain the desired engine speed.

When a transition from homogeneous to stratified is requested, the engine torque (Tq) is updated in step 520 using a function of the form shown below.

$$Tq=f_h(RPM, A/F_h, SA, P)$$

where, $A/F_h$ is the homogeneous air/fuel ratio.

Then, a determination is made in step 522 as to whether engine torque (Tq) is greater than the maximum achievable torque in the stratified mode ($[Tq^s]_{max}$). Where the maximum achievable torque in the stratified mode is given by a function of the form shown below:

$$[Tq^s]_{max}=\max[f_s(RPM, A/F_s, SA_s, EOI, P)]$$

where, $A/F_s$ is the stratified engine air/fuel and $SA_s$ is the stratified injection timing limit.

If the answer to 522 is YES, then a mode transition is impossible and is not allowed (step 524). If the answer to 522 is no, then the manifold pressure (P) is updated in step 526. Then, when the maximum achievable torque in the stratified mode ($[Tq^s(P)]_{max}$) at the manifold pressure (P) is greater than the engine torque (Tq) (step 528), the routine continues to step 530 where injection timing is retarded and engine air/fuel and throttle position are adjusted to maintain engine torque equal to Tq. Concurrently in step 530, feedback control may be used to maintain the desired engine speed. Then, when manifold pressure is less than an unthrottled manifold pressure (step 532), the throttle position may be increased by action of electronic throttle controller ETC and engine air/fuel may be increased by increasing the pulse width of signal fpw until unthrottled operation is achieved (step 534). Alternatively, when the maximum achievable torque in the stratified mode ($[Tq^s(P)]_{max}$) at the manifold pressure (P) is less than the engine torque (Tq)

(step 528), the routine continues to step 538 where the throttle position and fuel injection are used to adjust the manifold pressure while maintaining constant torque. In particular, throttle position is increased by action of electronic throttle controller ETC, thus unthrottling airflow, and engine air/fuel ratio is enleaned.

This concludes a description of an example of operation which uses the invention claimed herein to advantage. Many alterations and modifications will come to mind without departing from the scope of the invention. For example, this mode transition method may be used under other operating conditions, such as, for example, during low speed and low load conditions or during highway cruising operation. Accordingly, it is intended that the invention be defined only by the following claims.

We claim:

1. A mode control system for a spark ignited engine having a homogeneous mode of operation with a homogeneous mixture of air and fuel within a plurality of combustion chambers and a stratified mode of operation with a stratified mixture of air and fuel within the plurality of combustion chambers comprising:

an air intake with a throttle positioned therein; and a controller for estimating an initial manifold pressure and an initial torque; estimating a first expected alternate mode torque based on said initial manifold pressure; when said first expected alternate mode torque is less than said initial torque and an alternate mode is homogeneous operation, adjusting an injection timing for the alternate mode of operation while adjusting an ignition timing to move said first expected torque towards said initial torque; when said first expected alternate mode torque is greater than said initial torque and said alternate mode is homogeneous operation, adjusting the throttle to reduce said first expected alternate mode torque by a predetermined amount and subsequently adjusting an injection timing for said alternate mode of operation while adjusting an ignition timing to move said first expected alternate mode torque towards said initial torque; when said first expected alternate mode torque is less than said initial torque and said alternate mode is stratified operation, adjusting the throttle to increase said first expected alternate mode torque by a predetermined amount and subsequently adjusting an injection timing for the alternate mode of operation while adjusting an air/fuel ratio to move said first expected alternate mode torque towards said initial torque; and when said first expected alternate mode torque is greater than said initial torque and said alternate mode is stratified operation, adjusting an injection timing for the alternate mode of operation while adjusting an air/fuel ratio to move said first expected alternate mode torque towards said initial torque.

2. A mode control method for a spark ignited engine having an air intake with a throttle positioned therein and having a homogeneous mode of operation with a homogeneous mixture of air and fuel within a plurality of combustion chambers and a stratified mode of operation with a stratified mixture of air and fuel within the plurality of combustion chambers comprising:

estimating an initial stratified manifold pressure and an initial stratified torque;

estimating a first expected homogeneous torque based on said initial stratified manifold pressure;

when said first expected homogeneous torque is less than said initial stratified torque, adjusting an injection timing for the homogeneous mode of operation while adjusting an ignition timing to move said first expected homogeneous torque towards said initial stratified torque; and when said first expected homogeneous torque is greater than said initial stratified torque, adjusting the throttle to reduce said first expected homogeneous torque by a predetermined amount and subsequently adjusting an injection timing for the homogeneous mode of operation while adjusting an ignition timing to move said first expected homogeneous torque towards said initial stratified torque.

3. The method recited in claim 2 wherein said step of estimating said first expected homogeneous torque based on said initial stratified manifold pressure further comprises the step of estimating said first expected homogeneous torque based on said initial stratified manifold pressure and an ignition timing retard limit.

4. The method recited in claim 2 wherein said step of when said first expected homogeneous torque is greater than said initial stratified torque, adjusting the throttle to reduce said first expected homogeneous torque by said predetermined amount, further comprises the step of adjusting the throttle and richening an air/fuel ratio to reduce said first expected homogeneous torque by said predetermined amount while maintaining said initial stratified torque substantially constant.

5. The method recited in claim 2 wherein said step of estimating said initial stratified torque further comprises the step of estimating said initial stratified torque based on an engine speed, a stratified air/fuel ratio, a stratified injection timing, and said initial stratified manifold pressure.

6. The method recited in claim 2 wherein said step of estimating said first expected homogeneous torque based on said initial stratified manifold pressure further comprises the step of estimating said first expected homogeneous torque based on said initial stratified manifold pressure, a homogeneous lean air/fuel ratio lean limit, and an ignition timing retard limit.

7. The method recited in claim 2 further comprising the step of further adjusting the throttle and an air/fuel ratio based on an engine speed error and an air/fuel ratio error.

8. A mode control method for a spark ignited engine having an air intake with a throttle positioned therein and having a homogeneous mode of operation with a homogeneous mixture of air and fuel within a plurality of combustion chambers and a stratified mode of operation with a stratified mixture of air and fuel within the plurality of combustion chambers comprising:

estimating an initial homogeneous manifold pressure and an initial homogeneous torque;

estimating a first expected stratified torque based on said initial homogeneous manifold pressure;

when said first expected stratified torque is less than said initial homogeneous torque, adjusting the throttle to increase said first expected stratified torque by a predetermined amount and subsequently adjusting an injection timing for the stratified mode of operation while adjusting an air/fuel ratio to move said first expected stratified torque towards said initial homogeneous torque; and when said first expected stratified torque is greater than said initial homogeneous torque, adjusting an injection timing for the stratified mode of operation while adjusting an air/fuel ratio to move said first expected stratified torque towards said initial homogeneous torque.

9. The method recited in claim 8 further comprising the step of aborting said method when a difference between said first expected stratified torque and said initial homogeneous torque is greater than a predetermined value.

10. The method recited in claim 8 further comprising the steps of estimating a stratified manifold pressure when said first expected torque equals said initial homogeneous torque and said manifold pressure is less than an unthrottled manifold pressure; and further adjusting said throttle position and said air/fuel ratio when said stratified manifold pressure is less than an unthrottled manifold pressure.

11. The method recited in claim 8 wherein said step of estimating said first expected stratified torque based on said initial homogeneous manifold pressure further comprises the step of estimating said first expected stratified torque based on said initial homogeneous manifold pressure and a rich stratified air/fuel ratio limit.

12. The method recited in claim 8 wherein said step of when said first expected stratified torque is less than said initial homogeneous torque, adjusting the throttle to increase said first expected stratified torque by a predetermined amount, further comprises the step of adjusting the throttle and retarding a homogeneous ignition timing to increase said first expected stratified torque by said predetermined amount while maintaining said initial homogeneous torque substantially constant.

13. The method recited in claim 8 wherein said step of estimating said initial homogeneous torque further comprises the step of estimating said homogeneous torque based on an engine speed, a homogeneous air/fuel ratio, a homogeneous injection timing, a homogeneous ignition timing, and said initial homogeneous manifold pressure.

14. The method recited in claim 8 further comprising the step of further adjusting the throttle and said air/fuel ratio based on an engine speed error.

15. The method recited in claim 8 wherein said step of estimating said first expected stratified torque based on said initial homogeneous manifold pressure further comprises the step of estimating said first expected stratified torque based on said initial homogeneous manifold pressure, a stratified air/fuel ratio, a stratified injection timing, and a stratified ignition timing.

* * * * *